US010920488B2

(12) United States Patent
Toda et al.

(10) Patent No.: US 10,920,488 B2
(45) Date of Patent: Feb. 16, 2021

(54) ROLL SCREEN DEVICE

(71) Applicant: SEIKI HANBAI CO., LTD., Tokyo (JP)

(72) Inventors: Hirotsugu Toda, Tokyo (JP); Masato Moriya, Tokyo (JP)

(73) Assignee: SEIKI HANBAI CO., LTD., Tokyo (JP)

( * ) Notice: Subject to any disclaimer, the term of this patent is extended or adjusted under 35 U.S.C. 154(b) by 242 days.

(21) Appl. No.: 16/089,914

(22) PCT Filed: Mar. 16, 2017

(86) PCT No.: PCT/JP2017/010561
§ 371 (c)(1),
(2) Date: Sep. 28, 2018

(87) PCT Pub. No.: WO2017/169818
PCT Pub. Date: Oct. 5, 2017

(65) Prior Publication Data

US 2019/0119979 A1 Apr. 25, 2019

(30) Foreign Application Priority Data

Mar. 30, 2016 (JP) ..... JP2016-067745
Mar. 30, 2016 (JP) ..... JP2016-067746

(51) Int. Cl.
*E06B 9/54* (2006.01)
*E06B 9/58* (2006.01)
*E06B 9/42* (2006.01)

(52) U.S. Cl.
CPC ..... *E06B 9/54* (2013.01); *E06B 9/42* (2013.01); *E06B 9/58* (2013.01); *E06B 2009/543* (2013.01)

(58) Field of Classification Search
CPC . E06B 9/52; E06B 9/521; E06B 9/522; E06B 9/54; E06B 9/42; E06B 9/58; E06B 9/581; E06B 2009/543
(Continued)

(56) References Cited

U.S. PATENT DOCUMENTS 649,729 A * 5/1900 Isbills ..... A47H 15/04 16/93 D
3,842,890 A * 10/1974 Kramer ..... E06B 9/13 160/26
(Continued)

FOREIGN PATENT DOCUMENTS

JP H8-1654 * 12/1996 ..... E06B 9/56
JP H8-1654 U 12/1996
(Continued)

OTHER PUBLICATIONS

International Search Report, Japan Patent Office, International Patent Application No. PCT/JP2017/010561, dated Jun. 6, 2017, 4 pages.

*Primary Examiner* — Johnnie A. Shablack
(74) *Attorney, Agent, or Firm* — Fitch, Even, Tabin & Flannery LLP

(57) ABSTRACT

There is provided a screen device that is capable of preventing deformation such as loosening of a horizontally-sliding roll screen due to the weight of the screen. A guide member has a slit that allows a fastener-like member at an upper end of the screen to be slidably engaged therewith in a retained state. In a state in which a space, which allows bending in the vertical direction, is formed above the guide member, both end portions and of the guide member are fixed to an upper horizontal frame of a screen frame, flange portions of the guide member are positioned above protruding walls in the upper horizontal frame, and spring members that apply upward urging forces to the guide member are
(Continued)

provided between the protruding walls and the flange portions. Thus, deformation of the screen due to the weight thereof is suppressed by using the guide member.

7 Claims, 8 Drawing Sheets

(58) Field of Classification Search
USPC ..... 160/26, 23.1, 120, 274, 277, 196.1, 160/267.1, 272, 273.1, 270, 269, 266
See application file for complete search history.

(56) References Cited

U.S. PATENT DOCUMENTS 4,102,008 A * 7/1978 Janson ..... A47H 1/04 16/95 R
4,821,786 A * 4/1989 Johnston ..... E06B 9/40 16/78
4,993,468 A * 2/1991 Hackman ..... E06B 9/264 160/100
6,003,583 A * 12/1999 Lacoste ..... E06B 9/54 160/122
6,059,007 A * 5/2000 Tomita ..... E06B 9/54 160/242
6,478,070 B2 * 11/2002 Poppema ..... E06B 9/54 160/23.1
6,629,555 B2 * 10/2003 DeBlock ..... E06B 9/54 160/275
6,672,365 B2 * 1/2004 Therrien ..... E06B 3/9647 160/369
6,701,994 B2 * 3/2004 Goldenberg ..... E06B 9/54 160/120
6,814,127 B2 * 11/2004 Tagtow ..... E06B 9/54 160/273.1
7,100,667 B2 * 9/2006 Tomita ..... E06B 9/54 160/23.1
7,210,513 B2 * 5/2007 Goldenberg ..... E06B 9/54 160/296
7,370,685 B2 * 5/2008 Moriya ..... E06B 9/54 160/120
7,653,966 B2 * 2/2010 Quinn ..... E05D 15/0652 16/96 R
7,669,634 B2 * 3/2010 Sugiyama ..... E06B 9/90 160/242
7,861,761 B2 * 1/2011 Martineau ..... E06B 9/54 160/31
7,931,070 B2 * 4/2011 Chino ..... E06B 9/52 160/194
8,196,638 B2 * 6/2012 Roberts ..... E06B 9/54 160/84.06
8,291,960 B2 * 10/2012 Bowman ..... E06B 9/581 160/267.1
8,533,910 B2 * 9/2013 Bennett ..... A47H 15/04 16/87.8
8,656,978 B2 * 2/2014 Goldenberg ..... E06B 9/56 160/31
8,925,614 B2 * 1/2015 Okachi ..... E06B 9/54 160/31
9,351,599 B2 * 5/2016 Roberts ..... A47H 5/03
9,371,689 B2 * 6/2016 Licciardi Di Stefano ..... E06B 9/581
2001/0035268 A1 * 11/2001 Desrochers ..... E06B 9/54 160/31
2005/0098276 A1 * 5/2005 Agliolo Quartalaro .. E06B 9/54 160/276
2007/0039698 A1 * 2/2007 Chino ..... E06B 9/54 160/84.06
2007/0277944 A1 * 12/2007 Wu ..... A47H 13/01 160/330
2008/0210385 A1 * 9/2008 Sawyers ..... E06B 9/54 160/31
2011/0061819 A1 * 3/2011 Elinson ..... A47H 21/00 160/196.1
2015/0007502 A1 * 1/2015 Poppema ..... E06B 9/522 49/469
2016/0032646 A1 * 2/2016 Fleischman ..... E06B 9/58 160/309
2018/0148974 A1 * 5/2018 Roberts ..... E05D 15/26
2019/0048659 A1 * 2/2019 Toda ..... E06B 9/54
2019/0119979 A1 * 4/2019 Toda ..... E06B 9/54
2019/0301242 A1 * 10/2019 Shipman ..... E06B 9/58

FOREIGN PATENT DOCUMENTS

JP 2004-176473 A 6/2004
JP 2004-346578 A 12/2004
JP 2008-057232 A 3/2008

* cited by examiner

ROLL SCREEN DEVICE

CROSS-REFERENCE TO RELATED APPLICATIONS

This application is a U.S. national phase application of International Application No. PCT/JP2017/010561, filed Mar. 16, 2017, designating the United States, which claims priority to Japanese Patent Application No. 2016-067745, filed Mar. 30, 2016, and Japanese Patent Application no. 2016-067746, filed Mar. 30, 2016.

TECHNICAL FIELD

The present invention relates to a screen device to be installed in an opening of a building, and in particular, to a horizontally-sliding roll screen device that is used for repelling insects, blocking light, screening from view, insulating heat, decoration, or the like.

BACKGROUND ART

As an existing horizontally-sliding roll screen device, for example, a screen device (horizontally-sliding mesh screen) disclosed in Japanese Unexamined Patent Application Publication No. 2008-57232 is known. The screen device includes a roller box (stile), which contains a screen that is rolled around a roller shaft, and a pair of upper and lower horizontal frames (stiles), which incorporate guide members (guide bodies) for guiding upper and lower ends of the screen. The screen device allows the screen to be opened or closed horizontally by causing the guide members to respectively guide the upper and lower ends of the screen when the screen is unrolled from the roller shaft. In such a known screen device, fastener-like members, to each of which multiple engagement pieces (linear protrusions) are attached along the entire length thereof, are provided at upper and lower edge portions of the screen; slits, each of which has a smaller opening width than the width of the engagement pieces, are formed in the upper and lower guide members; and the engagement pieces are movably attached to the slits in a retained state.

Building openings, in which such a horizontally-sliding roll screen device is to be set, have various sizes, and it is desired that such a roll screen device can be installed in a building opening having a larger opening width or a larger opening area. In such a case, it is necessary to use a larger screen frame and a larger screen (mesh) in accordance with the opening width or the opening area. However, if such a large-sized screen is to be stretched in a screen frame using a screen support member that is used in existing roll screen devices, since the weight of the screen is larger, deformation, such as warping or straining, may occur in a part of the member due to the weight of the screen. It is also desired that a thicker screen having a large weight per unit area can be used at a position where a screen frame having an insufficient strength is set, and the same applies to such a case.

SUMMARY OF INVENTION

Technical Problem

The present invention has been made in the circumstances described above, and the technical object thereof is to provide a roll screen device that can prevent, with simple means, a screen from deforming because of warping or straining of a guide member that supports the screen due to the weight of the screen in a spread state of the screen or from sagging and looking unpleasantly due to ageing of the screen itself, and that has a structure that does not impede smooth movement of an operation stile and does not apply a load to a fastener-like member that is provided at an upper edge portion of the screen and engages with the guide member.

Solution to Problem

To achieve the object, according to the present invention, there is provided a roll screen device in which a screen frame includes at least a pair of side frames facing each other and an upper horizontal frame that is disposed between upper ends of the side frames and that has a channel shape that is open downward; one of the side frames is structured as a roller box containing a roller shaft that rolls up one end of a screen; the other side frame is structured as a receiving frame that an operation stile that is attached to the other end of the screen contacts when the screen is spread; a guide member that slidably holds an upper end of the screen along a longitudinal direction is contained in the upper horizontal frame, and the guide member has a slit that is formed in a lower surface thereof, the slit allowing a fastener-like member for guiding, which is attached along the upper end of the screen, to be slidably engaged therewith in a retained state; and an operation stile is attached to a leading end portion of the screen unrolled from the roller box, the operation stile allowing the screen to slide along the upper horizontal frame. The roll screen device has the following structure.

That is, a pair of protruding walls are provided in the upper horizontal frame that has a channel shape that is open downward, the protruding walls being directly or indirectly supported by the upper horizontal frame and facing each other inward along a longitudinal direction of the upper horizontal frame; the guide member includes a pair of flange portions that protrude outward from side walls on both sides along a longitudinal direction, the side walls forming the slit; in the upper horizontal frame, the pair of flange portions of the guide member are disposed so as to respectively face upper sides of the pair of protruding walls, and the side walls on both sides of the slit of the guide member are disposed between the pair of protruding walls; and both end portions of the guide member are fixed to the upper horizontal frame in a state in which a space is formed above the guide member in the upper horizontal frame, the space allowing the guide member to bend upward; and an urging member that applies an upward urging force to the guide member is provided between a corresponding one of the flange portions of the guide member and one of the protruding walls facing the flange portion, and the urging force that the urging member applies to the screen in a spread state is set in a range that suppresses deformation of a suspended shape due to a weight of the screen.

In a preferred embodiment of the roll screen device according to the present invention, a pair of engagement hooks are provided at upper end portions of the operation stile so as to face each other, and engagement stepped portions are respectively formed on both side walls of the guide member, the engagement stepped portions allowing the engagement hooks to slide by being engaged therewith and suspended along a longitudinal direction of the side walls; and the operation stile is formed so as to be slidable along the engagement stepped portions of the guide member in an opening/closing area of the screen.

With the roll screen device according to the present invention, which has the structure described above, in a state in which the screen is rolled around the roller shaft and stored in the roller box, a central part of the guide member is in a state of being pushed up by the upward urging force of the urging member, such as a spring member, which is disposed between the flange portion of the guide member and the protruding wall facing the flange portion. When the screen is unrolled and spread by using the operation stile from this state, the pair of engagement hooks the upper end portions of the operation stile engage with the engagement stepped portions of both the side walls of the guide member and slide. Therefore, the guide member is held in a state in which the weights of the operation stile and the screen balance out the strength of the guide member, both end portions of which are fixed to the upper horizontal frame, and the urging force of the spring member pushing up the central part of the guide member. By setting the strength of the guide member and the urging force of the spring member by using this appropriate balance position of the guide member as a steady movement path of the guide member, smooth movement of the operation stile is not impeded and a large load is not applied to the fastener-like member, which is disposed at an upper edge portion of the screen and engages with the guide member, and it is possible to smoothly move the operation stile.

When the screen is spread by operating the operation stile, because the weight of the operation stile is stopped from being applied to the guide member, the weight of the screen is applied to the entirety of the guide member in a state in which the screen is rolled up around the roller shaft. Therefore, the guide member is held in a state in which the weight of the screen excluding the weight of the operation stile balances out the strength of the guide member, both ends of which are fixed to the upper horizontal frame, and the urging force of the spring member that pushes up a central part of the guide member upward. By appropriate setting these, it is possible to suppress warping or straining of the guide member in a spread state of the screen and deformation of the screen caused thereby.

In a preferred embodiment, the roll screen device according to the present invention may be structured as follows: an inner horizontal frame that is formed in a channel shape that is open downward is attached to an inside of the upper horizontal frame so as to be downwardly rotatable by connecting the inner horizontal frame to an upper end portion of the roller box via a hinge, an engagement protrusion that is engageable with and disengageable from an engagement recess at an upper end portion of the receiving frame is provided at an end portion of the inner horizontal frame, and thereby the inner horizontal frame is downwardly rotatable via the hinge to a position along the roller box in a state in which the operation stile is moved to a side of the roller box; and the pair of protruding walls in the upper horizontal frame are provided in the inner horizontal frame so as to be integrated therewith, the guide member is disposed in the inner horizontal frame so that the pair of flange portions face the upper sides of the pair of protruding walls, and both ends of the guide member are fixed to the upper horizontal frame via both end portions of the inner horizontal frame.

With the roll screen device according to the present invention, a mechanism that can suppress unpleasantly-looking deformation of the screen in a spread state of the screen, such as sagging of the screen, which may occur if warping or straining occurs in members that support the screen due to the weight of the screen, is used. Therefore, it is expected that adjustments of the urging force of the urging member, the fixed state of the guide member, and the like be performed. The structure in which the rotatable inner horizontal frame is disposed inside the upper horizontal frame is effective not only in facilitating installation/removal of the screen device in/from a building opening but also in facilitating operations such as the aforementioned adjustments by folding the horizontal frame compactly.

In a preferred embodiment of the roll screen device according to the present invention, one end portion of the spring member is fixed to one of the flange portion of the guide member and the protruding wall in the upper horizontal frame, and the other end portion of the spring member is in contact with or fixed to the other of the flange portion and the protruding wall. A pair of ribs are provided in the upper horizontal frame having a channel shape, the ribs protruding upward toward lower surfaces of the pair of flange portions of the guide member along the longitudinal direction of the upper horizontal frame, and the ribs set a limit to which the guide member is downwardly movable due to the weight of the screen.

In a preferred embodiment of the roll screen device according to the present invention, in addition to providing the guide member at the upper part of the screen frame, the screen frame includes a lower horizontal frame that is disposed between lower ends of the pair of side frames facing each other and that has a channel shape that is open upward; a lower guide member that slidably holds a lower end of the screen along a longitudinal direction is contained in the lower horizontal frame; and a slit is formed in an upper surface of the guide member, the slit allowing a fastener-like member for guiding, which is attached along the lower end of the screen, to be slidably engaged therewith in a retained state.

In another preferred embodiment of the roll screen device according to the present invention, an inner horizontal frame is rotatably connected to an upper end portion of the roller box via a hinge to an inside of the upper horizontal frame of the screen frame; the screen frame includes a lower horizontal frame that is disposed between lower ends of the pair of side frames and that has a channel shape that is open upward; the lower horizontal frame is attached so as to be upwardly rotatable by connecting the lower horizontal frame to a lower end portion of the roller box via a hinge, an end portion of the lower horizontal frame is engageable with and disengageable from a lower end portion of the receiving frame, and thereby the lower horizontal frame is rotatable via the hinge in a direction along the roller box in a state in which the operation stile is moved to a side of the roller box; and a lower guide member that slidably holds a lower end of the screen along a longitudinal direction is contained in the lower horizontal frame; and a slit is formed in an upper surface of the guide member, the slit allowing a fastener-like member for guiding, which is attached along the lower end of the screen, to be slidably engaged therewith in a retained state.

In still another preferred embodiment of the roll screen device according to the present invention, the screen frame includes a screen guide and a guide rail between lower ends of the pair of side frames facing each other, the screen guide allowing a fastener-like member at a lower end of the screen to be engaged therewith and performing guiding, the guide rail guiding movement of the screen guide; the guide rail is shaped like a thin plate having a uniform width and includes a convex stepped portion that extends in a central part in a width direction of the guide rail; and the screen guide is structured as a connected body in which multiple guide pieces are connected to each other so as to be capable of becoming curved in an upwardly concave shape as a whole by arranging the guide pieces in a row and connecting the guide pieces to each other by inserting a continuous flexible wire in a through-hole formed in an upper end portion of each of the guide pieces; a slit is formed in an upper surface of each of the guide pieces so that the slits form a single linear slit array when the multiple guide pieces are connected, the slit allowing the fastener-like member at the lower end of the screen to be engaged therewith in a retained state; a recess that allows the guide piece to straddle the convex stepped portion of the guide rail is formed in a lower surface of each of the guide pieces; the connected body of the guide pieces is capable of straddling the convex stepped portion and being led into or out of a position on the guide rail from a storage chamber that vertically extends inside the operation stile; and one end of the screen guide is connected to a lower end of the roller box so that the fastener-like member at the lower end of the screen unrolled from the roller box engages with the slit array of the guide pieces.

Advantageous Effects of Invention

As described above, with the roll screen device according to the present invention, it is possible to provide a roll screen device that can prevent, with simple means, a screen from deforming due to warping or straining of a guide member that supports the screen due to the weight of the screen in a spread state of the screen or from sagging and looking unpleasantly due to ageing of the screen itself, and that has a structure that does not impede smooth movement of an operation stile and does not apply a load to a fastener-like member that is provided at an upper edge portion of the screen and engages with the guide member.

DESCRIPTION OF EMBODIMENTS

Figure 1:
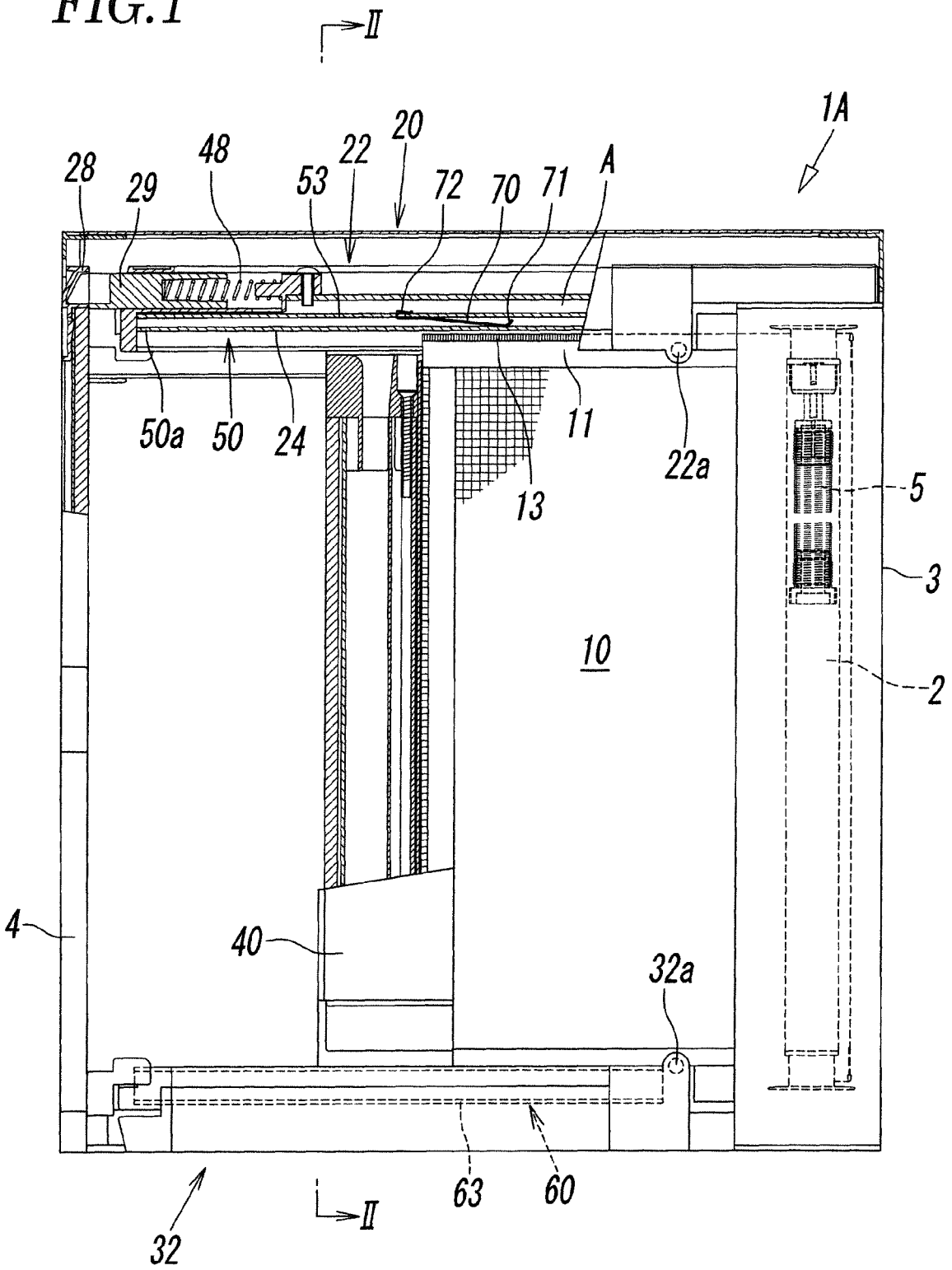
FIG. 1 is a partially cutaway front view illustrating the structure of a roll screen device according to a first embodiment of the present invention.

Hereinafter, referring to FIGS. 1 to 7, a first embodiment of a roll screen device according to the present invention will be described. A roll screen device 1A of the present embodiment is to be installed in a building opening for the purpose of repelling insects, blocking light, screening from view, insulating heat, decoration, or the like. The roll screen device 1A is applicable to, for example, a roll-type mesh screen device, a view-screening device, a sunshade device, or the like, and is particularly suitable for a roll-type mesh screen device.

In the roll screen device 1A, a screen frame, in which a screen 10 is stretched, at least includes an upper horizontal frame 20, which is disposed above the screen 10, and a pair of side frames, which face each other and extend in the vertical direction, at both ends of the upper horizontal frame 20. One of the side frames is structured as a roller box 3 in which a roller shaft 2, which rolls up one end of the screen 10, is contained so as to be rotatable about the axis thereof. The other side frame is structured as a receiving frame 4 that is disposed so as to face the roller box 3. The roll screen device 1A includes an operation stile 40 for operating the screen, which is connected to a leading end of the screen 10 rolled around the roller shaft 2, is located between the roller box 3 and the receiving frame 4, and is disposed parallel to these so as to be slidable. The receiving frame 4 allows the operation stile 40, which is attached to an end portion of the screen, to be in contact therewith when the screen 10 is spread.

To upper and lower ends of the screen 10, fastener-like members 11 and 12, which allow the screen 10 to be slidably engaged with an upper guide member 50 and a lower guide member 60 described below, are fixed by soldering or by using adhesive. The fastener-like members 11 and 12 each include a flexible strip, which is made from a synthetic resin sheet or a cloth, and multiple engagement pieces 13 (so-called teeth of a slide fastener) that are fixed to one side edge of the strip, which extends in the longitudinal direction, in a row over the entire length of the strip. If the screen 10 can be suspended under its own weight, it is not necessary to attach the fastener-like member 12 to the lower end of the screen 10 to guide the screen 10 with the guide member 60. However, the guide member 60 may be attached to the lower end of the screen to keep the screen stretched by using the weight of the guide member 60. One end of the screen 10 is connected to the roller shaft 2, and a coil spring 5, which is a driving source for rolling up the screen 10, is incorporated in the roller shaft 2.

The upper horizontal frame 20 is formed as an elongated member that has a channel shape that is open downward, and is structured to be fixed to an upper opening frame of a building opening. An inner horizontal frame 22, which is similarly formed as an elongated member that has a channel shape that is open downward, is disposed in the upper horizontal frame 20. One end portion of the inner horizontal frame 22 is connected to an upper end portion of the roller box 3 via a hinge 22*a*, and the other end portion of the inner horizontal frame 22 is downwardly rotatable. An engagement protrusion 29 is formed at the other end portion of the inner horizontal frame 22; an engagement recess 28, which allows the engagement protrusion 29 to be engaged therewith, is formed in an upper end portion of the receiving frame 4; and the engagement protrusion 29 is engageable with and disengageable from the receiving frame 4. The engagement protrusion 29 is held by the inner horizontal frame 22 via a spring 48 so as to be protrudable and retractable, and is engageable with and disengageable from the engagement recess 28 as the spring 48 extends and contracts.

The structure of the inner horizontal frame 22 enables the inner horizontal frame 22 to be folded compactly when installing/removing the screen device 1A in/from a building opening or performing a maintenance operation or the like on the screen device 1A. That is, the inner horizontal frame 22 is downwardly rotatable via the hinge 22*a* to a position along the roller box 3 in a state in which the operation stile 40 is moved toward the roller box 3, which is located below the upper horizontal frame 20. Moreover, as described below, by enabling a lower horizontal frame 32 of the screen frame to be folded compactly to the same degree as the folding described above, installation of the roll screen device in the building opening, partial disassembly for maintenance or the like, and dismantling can be facilitated.

The inner horizontal frame 22, which is connected to the upper horizontal frame 20 via the hinge 22*a*, will be described further in detail. In the inner horizontal frame 22, the guide member 50, for guiding sliding of the screen 10 and an upper end portion of the operation stile 40 in the horizontal direction, is contained. The guide member 50 is formed of a synthetic resin and has an elongated linear shape. Both end portions 50*a* and 50*b* of the guide member 50 are attached to the inner horizontal frame 22 in a state in which a space A, which allows the guide member 50 to bend upward, is formed above the guide member 50 in the inner horizontal frame 22. Therefore, as can be understood from the following descriptions, the guide member 50 has slight flexibility in the vertical direction.

Figure 5:
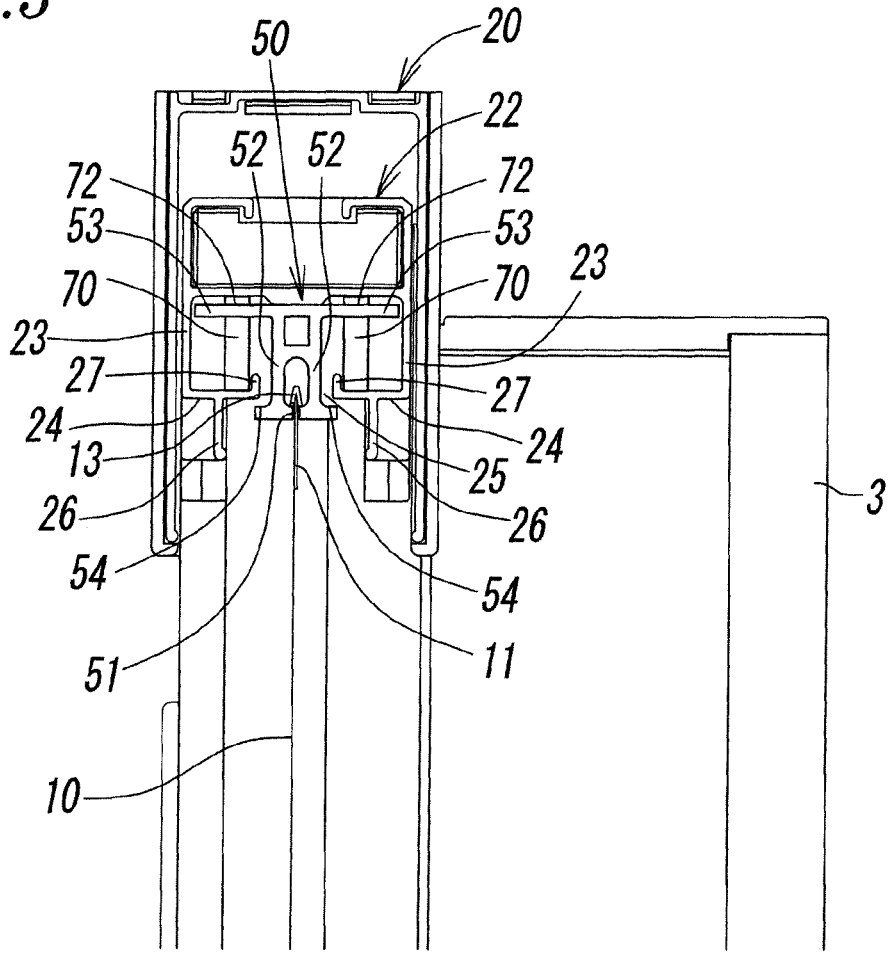
FIG. 5 is a detailed view illustrating a main part of an enlarged cross section taken along line V-V in FIG. 4.
Figure 7:
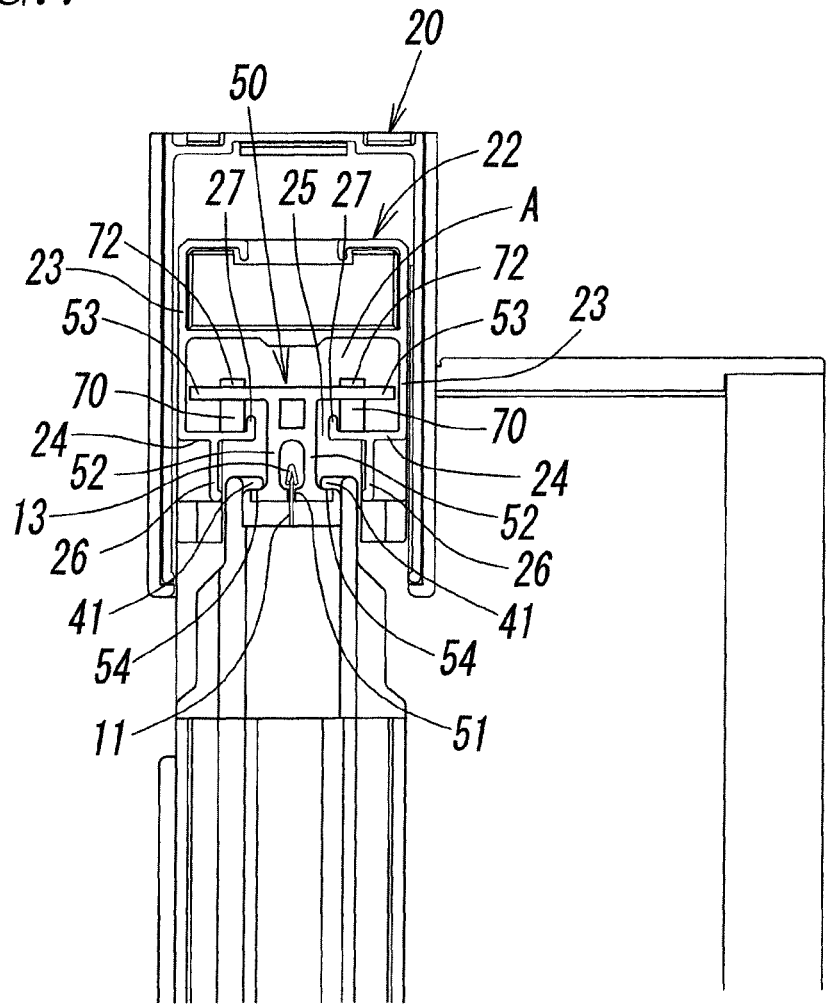
FIG. 7 is an enlarged sectional view taken along line VII-VII in FIG. 6.

As illustrated in FIGS. 5 and 7, in the inner horizontal frame 22, a pair of protruding walls 24 protrude inward from lower ends of both side walls 23, which face each other and extend in the longitudinal direction; an opening 25 is formed between end edges of the protruding walls 24; and a pair of ribs 27 extend upward from the end edges toward lower surfaces of a pair of flange portions 53 of the guide member 50 described below. The ribs 27 set a limit to which the guide member 50 is downwardly movable due to the weights of the screen 10 and like, which are suspended on the guide member 50. Moreover, a pair of extending walls 26 extend downward from lower surfaces of the protruding walls 24. The protruding walls 24, the extending walls 26, and the ribs 27 each extend along the longitudinal direction of the inner horizontal frame 22.

A slit 51, which allows the fastener-like member 11 at an upper edge of the screen 10 to be slidably engaged therewith in a retained state, is formed in a lower surface of the guide member 50 along the longitudinal direction. The groove width of the slit 51 is smaller than the width of each of the engagement pieces 13 at an end portion of the fastener-like member 11, and the width of a deep portion of the slit 51 is larger than the width of each of the engagement pieces 13. Therefore, in a state in which the screen 10 is unrolled from the roller box 3 and the engagement pieces 13 are inserted into the slit 51, the fastener-like member 11 engages with the inside of the slit 51 and is prevented from being removed from the slit 51.

The pair of flange portions 53, which extend in the longitudinal direction, protrude outward from upper end portions of a pair of side walls 52, which form the slit 51 of the guide member 50. Below the flange portions 53, a pair of engagement stepped portions 54, which support the operation stile 40, also protrude outward along the longitudinal direction. The width between ends of the pair of flange portions 53 is larger than the width of the opening 25 between both the side walls 23 of the inner horizontal frame 22. The distance between outer surfaces of the side walls 52 of the guide member 50 is slightly smaller than the width the opening 25 of the inner horizontal frame 22. The pair of engagement stepped portions 54 allow a pair of engagement hooks 41, which stand on upper end portions of the operation stile 40 so as to face each other, to be engaged therewith and slidably guide the operation stile 40. The engagement hooks 41 and the engagement stepped portions 54 are located between the pair of extending walls 26 of the inner horizontal frame 22 and prevent disengagement of these.

Figure 3:
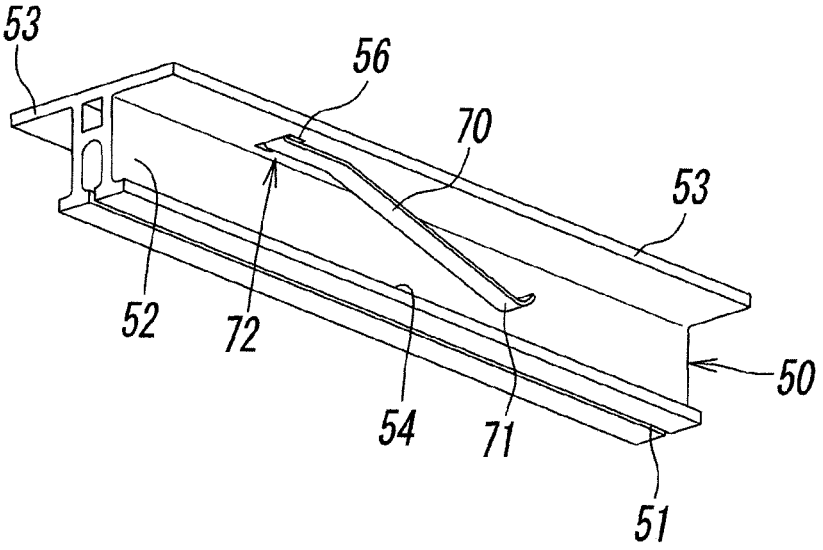
FIG. 3 is a perspective view of a main part of a guide member shown in FIG. 1.

Moreover, urging members, each of which is formed of a spring member 70 such as a plate spring as illustrated in FIG. 3 and which apply upward urging forces to the guide member 50, are disposed at substantially central parts of the flange portion 53 of the guide member 50 in the longitudinal direction. One end portion of the each of the spring members 70, which form the urging members, is fixed to a corresponding one of the flange portions 53 by using a fixing portion 72, which is formed by inserting one end portion of the spring member 70 into a corresponding one of through-holes 56 formed in the flange portions 53 and bending the end portion in the opposite direction. The other end of each of the spring members 70 is inclined diagonally downward from the fixing portion 72; a contact portion 71, which is curved so as to be downwardly convex, is formed at an end portion thereof, and the contact portion 71 is made to contact an upper part of a fixing portion in the upper horizontal frame 20 (here, the protruding wall 24 of the inner horizontal frame 22).

One end of the spring member 70 may be attached to one of the flange portion 53 of the guide member 50 and the protruding wall 24 in the inner horizontal frame 22, and the other end of the spring member 70 may be slidably in contact with or may be fixed to the other of the flange portion 53 and the protruding wall 24. The fixing portion 72 of the spring member 70 may be fixed by using a rivet or a screw. Moreover, as the urging member, a spring member other than a plate spring or various elastic members may be used, and the area where the urging member is disposed may be extended in the longitudinal direction of the guide member 50, as appropriate.

Urging forces that the spring members 70, which are urging members, apply to the guide member 50 between the flange portions 53 of the guide member 50 and the protruding walls 24 facing the flange portions 53, are applied via the guide member to the screen in a spread state. It is necessary that the urging forces be set in a range such that deformation of a suspended shape due to the weight of the screen is suppressed. It is preferable that the relationship among the urging forces of the spring members 70 applied to the guide member 50, the weight of the screen 10, and the like be adjusted so that the guide member 50 can have a desirably curved shape or a substantially linear shape in the state in which the screen 10 is spread. It is also possible to make a tensile force when fixing both the end portions 50*a* and 50*b* of the guide member 50 or the like be adjustable.

Figure 2:
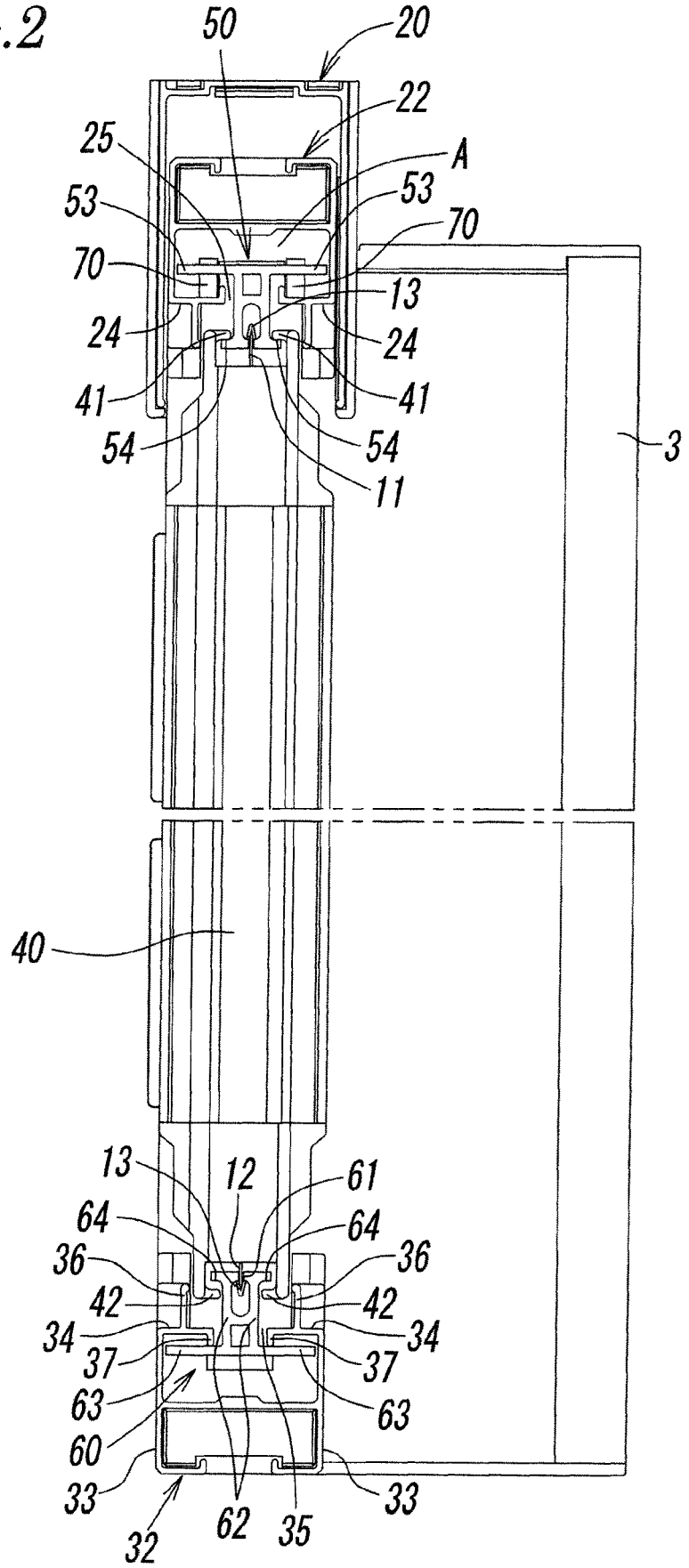
FIG. 2 is a sectional view illustrating an enlarged cross section taken along line II-II in FIG. 1 while omitting a middle part.
Figure 4:
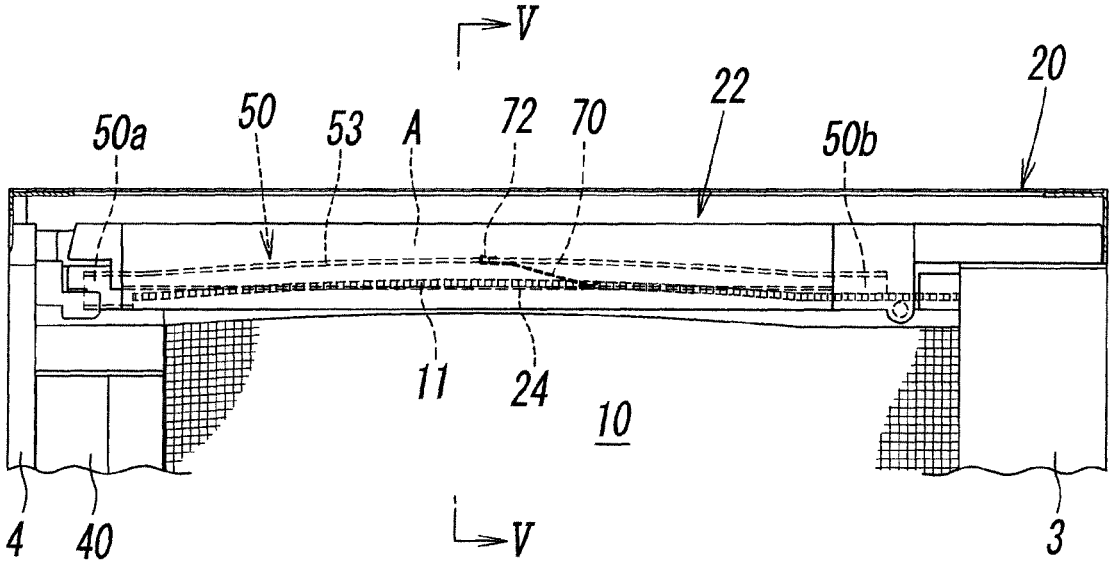
FIG. 4 is a partial front view illustrating a state in which a screen is stretched in the first embodiment.
Figure 6:
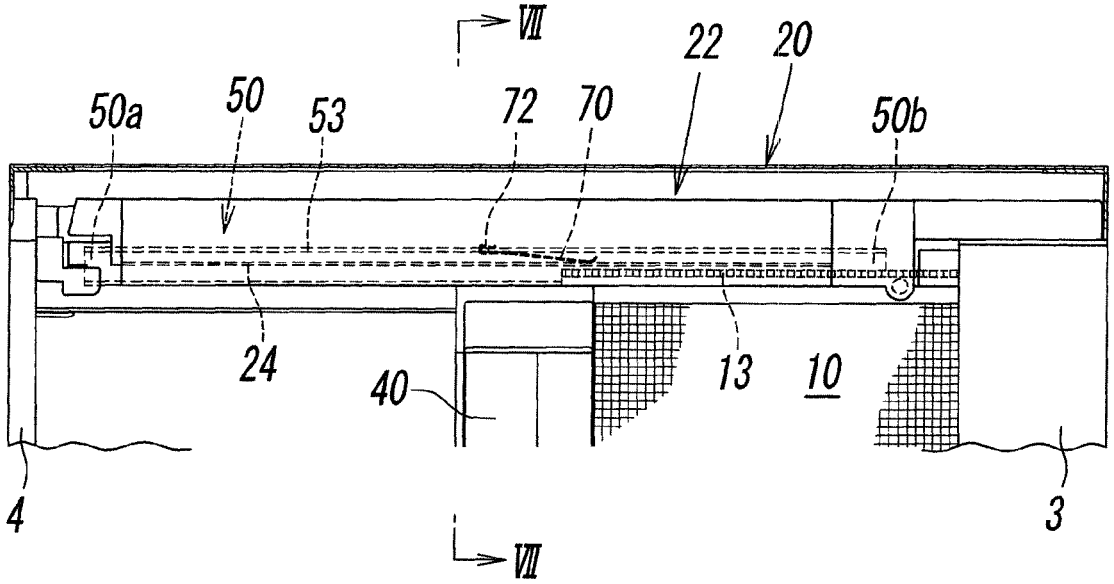
FIG. 6 is a partial front view illustrating a state in which the screen in the first embodiment is being opened or closed.

As illustrated in FIGS. 2, 5, and 7, the flange portions 53 of the guide member 50 are respectively disposed above the protruding walls 24 of the inner horizontal frame 22; the side walls 52, which form the slit 51, are contained in the inner horizontal frame 22 in a state in which the side walls 52 are disposed between the pair of protruding walls 24 through the opening 25; and as illustrated in FIGS. 4 and 6, both the end portions 50*a* and 50*b* of the guide member 50 are directly fixed to the inner horizontal frame 22. As a result, the guide member 50 is indirectly fixed to the upper horizontal frame 20. The space A is formed above the guide member 50, that is, between the guide member 50 and the inner horizontal frame 22. Thus, a middle part of the guide member 50 between both the end portions 50*a* and 50*b* can be bent so as to be upwardly curved in the inner horizontal frame 22.

Figure 10:
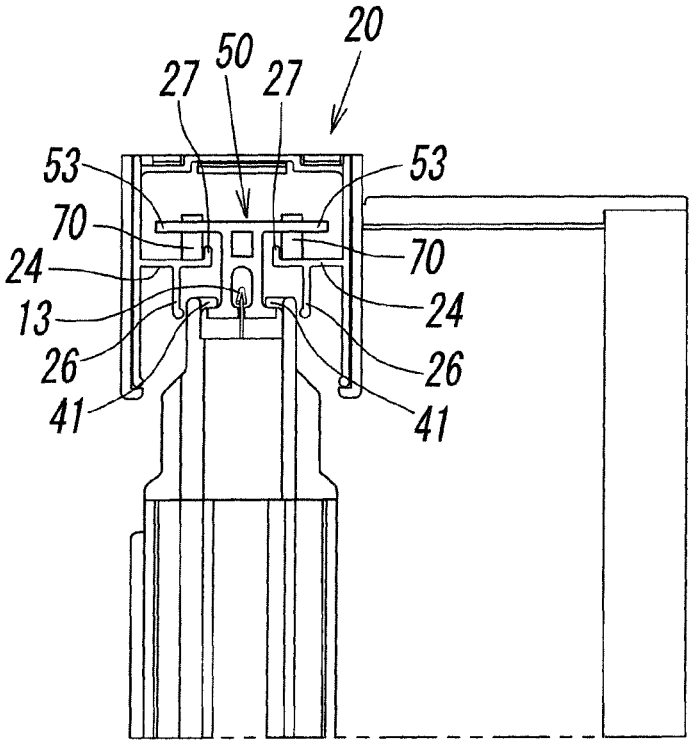
FIG. 10 is an enlarged sectional view of the embodiment shown in FIG. 7 without the inner horizontal frame.

In the first embodiment, as described above, the inner horizontal frame 22 is disposed in the upper horizontal frame 20 so as to be rotatable via the hinge 22*a* and can be used for assembly, partial disassembly for maintenance, dismantling, or the like. If such operations are not necessary, it is not necessary to dispose the inner horizontal frame 22 in the upper horizontal frame 20 (FIG. 10). In this case, naturally, without providing the inner horizontal frame 22 itself, the structures such as the protruding walls 24, the extending walls 26, the ribs 27, and the like, which are described above as being disposed in the inner horizontal frame 22, are directly disposed at corresponding portions of the upper horizontal frame 20, since they are necessary in relation to the guide member 50; and the guide member 50 is naturally disposed in the upper horizontal frame 20 and both ends thereof are directly fixed to the upper horizontal frame 20 (FIG. 10).

However, the first embodiment illustrated in FIGS. 1 to 7 has a structure such that the inner horizontal frame 22 is disposed in the upper horizontal frame 20. Therefore, hereinafter, the structure including the inner horizontal frame 22 will be described, and description of a case where the inner horizontal frame 22 is not provided (FIG. 10) will be understood therefrom and from the above description.

Next, referring to FIGS. 3, 4, and 7 and others, the structure and function of an urging mechanism that upwardly urges the guide member 50 by using the pair of spring members 70 attached thereto will be described.

In the roll screen device 1A, the pair of spring members 70 are disposed in contracted states at substantially the center of the guide member 50 in the longitudinal direction so as to apply repulsive forces to the flange portions 53 of the guide member 50 and the protruding walls 24 of the inner horizontal frame 22 facing the flange portions 53. Thus, upward urging forces are constantly applied to the flange portions 53 of the guide member 50. Therefore, in a state in which the screen 10 is completely rolled up around the roller shaft 2, the flange portions 53 of the guide member 50 are pushed up by the urging forces. However, because the screen 10 is not unrolled, the screen 10 is not affected by the urging forces of the spring members 70.

When the screen 10 is unrolled and spread by using the operation stile 40 from this state, the pair of engagement hooks 41 at the upper end portions of the operation stile 40 engage with the engagement stepped portions 54 of both the side walls 52 of the guide member 50 and start sliding. Therefore, the guide member 50 is held in a state in which the weights of the operation stile 40 and the screen 10 balance out the strength of the guide member 50, both end portions 50*a* and 50*b* of which are fixed, and the urging forces of the spring members 70 pushing up the central part of the guide member 50. As the operation stile 40 advances, the weight of the screen 10 on the roller box 3 side of the guide member 50 gradually increases. However, because the change in these weights is not abrupt, smooth sliding of the operation stile 40 is not impeded and a large load is not applied to the fastener-like member 11 at the upper edge portion of the screen 10, and the operation stile 40 can be smoothly moved.

When the screen 10 is completely spread by operating the operation stile 40, the weight of the screen 10 is evenly applied to the entire length of the guide member 50, but the weight of the operation stile 40 is stopped from being applied. By setting the strength of the guide member 50, the urging forces of the spring members 70, and the like by using the appropriate balance position of the guide member 50 in the vertical direction in this case as a steady movement path of the guide member 50, it is possible to smoothly move the operation stile 40 and, in addition, to suppress warping or straining of the guide member 50 in a spread state of the screen 10 and deformation of the screen caused thereby.

Heretofore, supporting of an upper part of the screen 10 by the upper guide member 50 has been described. Hereinafter, supporting of a lower part of the screen 10 by the lower guide member 60 will be described.

A lower part of the screen frame of the roll screen device 1A does not include a member corresponding to the upper horizontal frame 20, and includes the lower horizontal frame 32, which is a member corresponding to the inner horizontal frame 22 disposed in the upper horizontal frame 20 as illustrated in FIGS. 1, 2, 4, and 6. The lower horizontal frame 32 is basically symmetric to the inner horizontal frame 22 vertically. As with the inner horizontal frame 22, a base end portion of the lower horizontal frame 32 is upwardly rotatable via a hinge 32*a*. Although not illustrated, an end portion of the lower horizontal frame 32 is engageable with and disengageable from a lower end portion of the receiving frame 4, as with the upper portion. As with the inner horizontal frame 22 in the upper horizontal frame 20, this structure allows the lower horizontal frame 32 to be folded compactly and facilitates installation of the roll screen device in a building opening, partial disassembly for maintenance or the like, and dismantling.

As can be seen from FIG. 1, the internal structure of the lower horizontal frame 32 is substantially symmetric to the inner horizontal frame 22 vertically. A pair of protruding walls 34 protrude inward from upper ends of both side walls 33 facing each other, an opening 35 is formed between end edges of the protruding walls 34, and a pair of ribs 37 extend downward from the end edges toward upper surfaces of a pair of flange portions 63 of the lower guide member 60. Moreover, a pair of extending walls 36 stand upward from upper surfaces of the protruding walls 34. The protruding walls 34, the extending walls 36, and the ribs 37 each extend along the longitudinal direction of the lower horizontal frame 32.

In the lower horizontal frame 32, the guide member 60, which slidably guides the screen 10 and a lower end portion of the operation stile 40 in the horizontal direction, is contained. The lower guide member 60 has a structure similar to and vertically symmetric to that of the upper guide member 50. To be specific, the lower guide member 60 includes a slit 61, which allows the fastener-like member 12 at the lower end portion of the screen 10 to be engaged therewith in a retained state; the flange portions 63; and engagement stepped portions 64. Both ends of the lower guide member 60 are fixed to the lower horizontal frame 32. However, the lower guide member 60 does not have urging members, like the spring members 70 of the upper guide member 50, and therefore does not have through-holes for fixing the spring members 70 to the flange portions 63. Although urging members, such as the spring members 70, are not shown in the lower guide member 60 in the figures, urging members may be provided to apply a tensile force in the vertical direction to the screen.

As illustrated in FIG. 2, the operation stile 40 is guided by engaging the engagement hooks 41, which stand at upper end portions thereof so as to face each other, with the engagement stepped portions 54 of the upper guide member 50. At lower end portions of the operation stile 40, a pair of engagement hooks 42, which are similar to those at the upper end portions, are formed; and a lower part of the operation stile 40 is slidably held by the guide member 60 by interposing the engagement stepped portions 64 of the lower guide member 60 between the pair of engagement hooks 42. The engagement hooks 42 and the engagement stepped portions 64 are located between the pair of extending walls 36 of the lower horizontal frame 32.

With the structure described above, in a state in which the screen 10 is unrolled from the roller box 3 and stretched, the fastener-like members 11 and 12 at the upper and lower ends of the screen 10 engage with the slits 51 and 61 of the upper and lower guide members 50 and 60 in a retained state, and thereby the lower guide member 60 is suspended on the screen 10. Therefore, a tension is applied to the screen 10 in the vertical direction.

Moreover, with the roll screen device having the structure described above, maintenance and the like can be easily performed due to rotation of the inner horizontal frame 22 in an upper part and the lower horizontal frame 32. By making both the end portions 50*a* and 50*b* of the upper and lower guide members 50 and 60 be releasable, it is possible to remove the guide members 50 and 60 from the inner horizontal frame 22 in the upper part and from the lower horizontal frame 32, and it is possible to replace the guide members 50 and 60 and to replace the urging members.

Next, referring to FIGS. 8 and 9, a second embodiment of a roll screen device according to the present invention will be described. Here, elements that differ from those of the first embodiment will only be described. In order to avoid redundant description, elements that are substantially the same will be denoted by numerals that are the same as those in the first embodiment, and detailed descriptions of such elements will be omitted.

First, the main difference between a roll screen device 1B according to the second embodiment and the roll screen device 1A of the first embodiment is the structure of a screen guide 80, which guides a lower end portion of the screen 10 unrolled from the roller shaft 2. That is, the roll screen device 1B according to the second embodiment includes the screen guide 80, which allows the fastener-like member 12 at the lower end of the screen 10 to be engaged therewith and performs guiding, and a guide rail 81, which guides movement of the screen guide 80, at a position where the lower horizontal frame 32 of the screen frame is disposed in the first embodiment.

Figure 8:
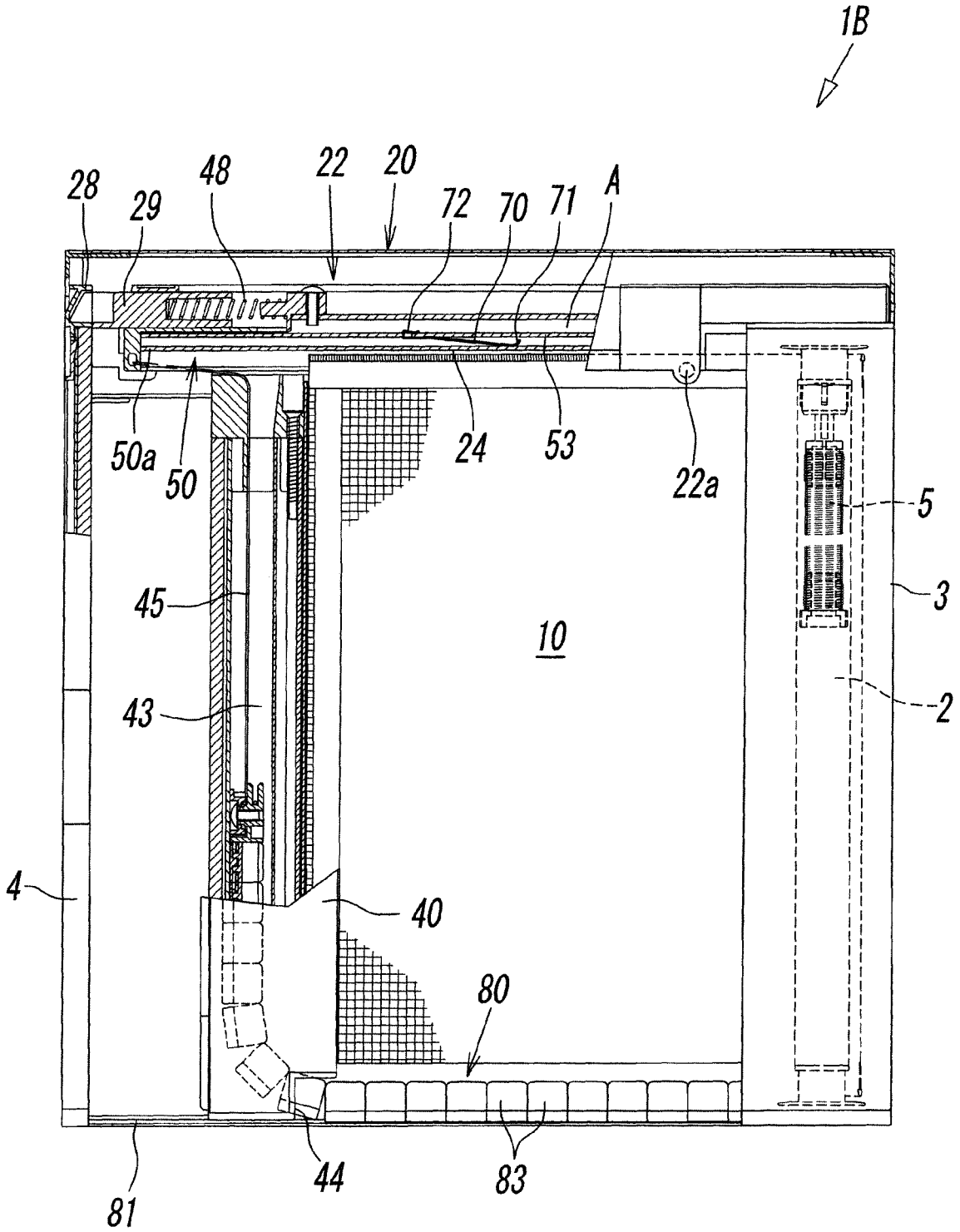
FIG. 8 is a partially cutaway front view illustrating a roll screen device according to a second embodiment of the present invention.
Figure 9:
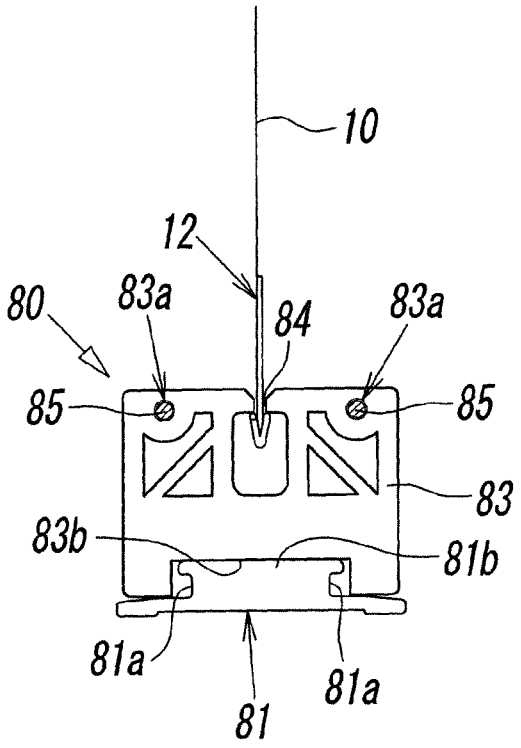
FIG. 9 is a sectional view illustrating a state in which a fastener-like member is engaged with a slit of a guide piece in FIG. 8.

As illustrated in FIGS. 8 and 9, the guide rail 81 has a thin plate-like shape having a uniform width. A pair of concave grooves 81*a* are formed in both side surfaces of a convex stepped portion 81*b*, which extends at a central part thereof in the width direction. The convex stepped portion 81*b* has a height such that stumbling can be avoided, in order to make the guide rail 81 barrier-free. The screen guide 80, which allows the fastener-like member 12 at the lower end portion to be slidably engaged therewith and performs guiding, is a connected body in which multiple guide pieces 83 are arranged in a row and adjacent guide pieces 83 are bendably connected to each other so as to be capable of becoming curved in an upwardly concave shape as a whole. The connected body can be led into and out of a position on the guide rail 81 from a storage chamber 43, which extends vertically in the operation stile 40.

A slit 84, which allows the fastener-like member 12 at the lower end of the screen 10 to be engaged therewith in a retained state, is formed in an upper surface of each of the guide pieces 83 of the screen guide 80. Moreover, the slits 84 are formed so as to form a single linear slit array when multiple guide pieces 83 are connected to each other. A pair of through-holes 83*a* are formed along the slit 84 in upper end portions of each of the guide pieces 83 on both sides of the slit 84. By inserting flexible wires 85 into the through-holes 83*a*, the multiple guide pieces 83 are connected so as to be bendable relative to each other. Moreover, a concave portion 83*b*, which allows each of the guide pieces 83 to straddle the convex stepped portion 81*b* of the guide rail 81, is formed in the lower surface of the guide piece 83.

In accordance with movement of the operation stile 40, the screen guide 80 is led into the storage chamber 43 in the operation stile 40 through an inlet-outlet 44 in the operation stile 40 when rolling up the screen 10, and is led out to a position on the guide rail 81 only when spreading the screen 10. Therefore, one end of the screen guide 80 is connected to a lower end of the roller box 3 while aligning the slits 84 in the guide pieces 83 with a position where the fastener-like member 12 of the screen 10 is led out, the other end of the screen guide 80 is inserted into the storage chamber 43 in the operation stile 40, a flexible wire 45 is connected to an end thereof, and an end of the wire 45 is guided toward the receiving frame 4 from an upper end of the storage chamber 43 and is connected to the inner horizontal frame 22 in the upper horizontal frame 20. This connection structure of the screen guide is effective in parallelly moving the operation stile 40.

In the roll screen device 1B having such a structure, when the screen is spread by horizontally moving the operation stile 40, the screen guide 80 is linearly led out of the operation stile 40 through the inlet-outlet 44 to a position on the guide rail 81 while engaging the fastener-like member 12 at the lower end of the screen 10, which is unrolled from the roller box 3, with the slit 84. Conversely, when the screen is stored, the screen guide 80 is led into the storage chamber 43 of the operation stile 40 from the position on the guide rail 81 through the inlet-outlet 44 while being upwardly curved.

Also in the second embodiment, as with the first embodiment, a substantially central part of the guide member 50, both the end portions 50*a* and 50*b* of which are fixed, is urged upward by the spring members 70, and the space A, which allows the guide member 50 to be bent, is formed above the guide member 50. Therefore, as illustrated in FIGS. 4 and 5, the guide member 50 is bent upward by the urging forces of the spring members 70, and thereby a central portion of the stretched screen 10 is lifted. As a result, tension of the screen 10 in the vertical direction is maintained, and loosening and warping of the screen 10 can be prevented.

However, at this time, if the screen guide 80 is not engaged so as not to be lifted upward from the guide rail 81, in a state in which the screen 10 is completely spread, the screen guide 80 is lifted from the guide rail 81 by the urging forces of the spring members 70. Therefore, it is necessary to prevent lifting of the guide pieces 83 from the guide rail 81 by providing the screen guide 80 with a certain weight or by forming protruding portions that engage with the concave grooves 81*a* on both sides of the convex stepped portion 81*b* of the guide rail 81 from both side surfaces of the concave portion 83*b* in the lower surface of the guide pieces 83.

Moreover, also in the second embodiment, as with the first embodiment, when an operation of opening or closing is being performed and the operation stile 40 is located at a middle position, as illustrated in FIGS. 6 and 7, the engagement hooks 41 of the operation stile 40 contact the engagement stepped portions 54 of the guide member 50 from above, and thereby warping of the guide member 50 is suppressed. As a result, a load applied to the fastener-like member 11 can be reduced, and the operation of opening or closing the screen 10 can be smoothly performed.

Heretofore, embodiments of a roll screen device according to the present invention have been described. Needless to say, the present invention is not limited to the embodiments described above and may be modified in design within the scope of the claims.

The invention claimed is:

1. A roll screen device, comprising:

a screen frame including at least a pair of side frames facing each other and an upper horizontal frame that is disposed between upper ends of the side frames and that has a channel shape that is open downward;

one of the side frames structured as a roller box containing a roller shaft that rolls up one end of a screen;

the other side frame structured as a receiving frame that an operation stile, that is attached to the other end of the screen, contacts when the screen is spread;

a guide member that slidably holds an upper end of the screen along a longitudinal direction, the guide member contained in the upper horizontal frame, and the guide member having a slit that is formed in a lower surface thereof, the slit allowing engagement pieces for guiding, which are attached along the upper end of the screen, to be slidably engaged therewith in a retained state; and the operation stile being attached to a leading end portion of the screen unrolled from the roller box, the operation stile allowing the screen to slide along the upper horizontal frame, wherein a pair of protruding walls are provided in the upper horizontal frame that has a channel shape that is open downward, the protruding walls being directly or indirectly supported by the upper horizontal frame and facing each other inwardly along a longitudinal direction of the upper horizontal frame, wherein the guide member includes a pair of flange portions that protrude outwardly from side walls on both sides along a longitudinal direction, the side walls forming the slit, wherein, in the upper horizontal frame, the pair of flange portions of the guide member are disposed so as to respectively face upper sides of the pair of protruding walls, and the side walls on both sides of the slit of the guide member are disposed between the pair of protruding walls; and both end portions of the guide member are fixed to the upper horizontal frame in a state in which a space is formed above the guide member in the upper horizontal frame, the space allowing the guide member to bend upward, wherein an urging member that applies an upward urging force to the guide member is provided between a corresponding one of the flange portions of the guide member and one of the protruding walls facing the flange portion, and the urging force that the urging member applies to the screen in a spread state is set in a range that suppresses deformation of a suspended shape due to a weight of the screen, wherein a pair of engagement hooks are provided at upper end portions of the operation stile so as to face each other, and engagement stepped portions are respectively formed on both side walls of the guide member, the engagement stepped portions allowing the engagement hooks to slide by being engaged therewith and suspended along a longitudinal direction of the side walls, and wherein the operation stile is formed so as to be slidable along the engagement stepped portions of the guide member in an opening/closing area of the screen.

2. The roll screen device according to claim 1, wherein the urging member is a spring member, one end portion of the spring member is fixed to one of the flange portion of the guide member and the protruding wall in the upper horizontal frame, and the other end portion of the spring member is in contact with or fixed to the other of the flange portion and the protruding wall.

3. The roll screen device according to claim 1, wherein a pair of ribs are provided in the upper horizontal frame having a channel shape, the ribs protruding upward toward lower surfaces of the pair of flange portions of the guide member along the longitudinal direction of the upper horizontal frame, and the ribs set a limit to which the guide member is downwardly movable due to the weight of the screen.

4. The roll screen device according to claim 1, wherein the screen frame includes a lower horizontal frame that is disposed between lower ends of the pair of side frames facing each other and that has a channel shape that is open upward;

wherein a lower guide member that slidably holds a lower end of the screen along a longitudinal direction is contained in the lower horizontal frame; and wherein a slit is formed in an upper surface of the lower guide member, the slit of the lower guide member allowing engagement pieces for guiding, which are attached along the lower end of the screen, to be slidably engaged therewith in a retained state.

5. The roll screen device according to claim 1, wherein the screen frame includes a screen guide and a guide rail between lower ends of the pair of side frames facing each other, the screen guide allowing engagement pieces at a lower end of the screen to be engaged therewith and performing guiding, the guide rail guiding movement of the screen guide, wherein the guide rail is shaped like a thin plate having a uniform width and includes a convex stepped portion that extends in a central part in a width direction of the guide rail, and wherein the screen guide is structured as a connected body in which multiple guide pieces are connected to each other so as to be capable of becoming curved in an upwardly concave shape as a whole by arranging the guide pieces in a row and connecting the guide pieces to each other by inserting a continuous flexible wire in a through-hole formed in an upper end portion of each of the guide pieces;

wherein a slit is formed in an upper surface of each of the guide pieces so that the slits form a single linear slit array when the multiple guide pieces are connected, the slit of a lower guide member allowing the engagement pieces at the lower end of the screen to be engaged therewith in a retained state;

wherein a recess in each guide piece allows each guide piece to straddle the convex stepped portion of the guide rail, each recess being formed in a lower surface of each of the guide pieces;

wherein the connected body of the guide pieces is capable of straddling the convex stepped portion and being led into or out of a position on the guide rail from a storage chamber that vertically extends inside the operation stile; and wherein one end of the screen guide is connected to a lower end of the roller box so that the engagement pieces at the lower end of the screen unrolled from the roller box engages with the slit array of the guide pieces.

6. The roll screen device according to claim 1, wherein an inner horizontal frame that is formed in a channel shape that is open downward is attached to an inside of the upper horizontal frame so as to be downwardly rotatable by connecting the inner horizontal frame to an upper end portion of the roller box via a hinge, an engagement protrusion that is engageable with and disengageable from an engagement recess at an upper end portion of the receiving frame is provided at an end portion of the inner horizontal frame, and thereby the inner horizontal frame is downwardly rotatable via the hinge to a position along the roller box in a state in which the operation stile is moved to a side of the roller box, and wherein the pair of protruding walls in the upper horizontal frame are provided in the inner horizontal frame so as to be integrated therewith, the guide member is disposed in the inner horizontal frame so that the pair of flange portions face the upper sides of the pair of protruding walls, and both ends of the guide member are fixed to the upper horizontal frame via both end portions of the inner horizontal frame.

7. The roll screen device according to claim 6, wherein the screen frame includes a lower horizontal frame that is disposed between lower ends of the pair of side frames facing each other and that has a channel shape that is open upward; and the lower horizontal frame is attached so as to be upwardly rotatable by connecting the lower horizontal frame to a lower end portion of the roller box via a hinge, an end portion of the lower horizontal frame is engageable with and disengageable from a lower end portion of the receiving frame, and thereby the lower horizontal frame is rotatable via the hinge of the lower end of the roller box in a direction along the roller box in a state in which the operation stile is moved to a side of the roller box, and wherein a lower guide member that slidably holds a lower end of the screen along a longitudinal direction is contained in the lower horizontal frame; and a slit is formed in an upper surface of the lower guide member, the slit of the lower guide member allowing engagement pieces for guiding, which are attached along the lower end of the screen, to be slidably engaged therewith in a retained state.

* * * * *